US011291308B1

(12) United States Patent
Aramli

(10) Patent No.: US 11,291,308 B1
(45) Date of Patent: Apr. 5, 2022

(54) PRODUCT INCLUDES A LIP PROJECTING FROM AN OUTER PERIMETER OF AN UNDERSIDE OF A MATTRESS TO DEFINE A RECESSED CAVITY AND HAVING GAPS IN THE LIP FOR PASSAGE OF A POWER CORD

(71) Applicant: BEDJET LLC, Newport, RI (US)

(72) Inventor: Mark Darius Aramli, Newport, RI (US)

(73) Assignee: BedJet LLC, Newport, RI (US)

( * ) Notice: Subject to any disclaimer, the term of this patent is extended or adjusted under 35 U.S.C. 154(b) by 0 days.

(21) Appl. No.: 17/061,656

(22) Filed: Oct. 2, 2020

(51) Int. Cl.

| | |
|---|---|
| ***A47C 20/04*** | (2006.01) |
| ***A47C 20/08*** | (2006.01) |
| ***A47C 27/14*** | (2006.01) |
| ***A47C 27/20*** | (2006.01) |
| ***A47C 27/00*** | (2006.01) |
| ***A47C 27/16*** | (2006.01) |
| ***A47C 27/15*** | (2006.01) |

(52) U.S. Cl.
CPC ..... *A47C 27/001* (2013.01); *A47C 27/146* (2013.01); *A47C 27/15* (2013.01); *A47C 27/16* (2013.01)

(58) Field of Classification Search
CPC ..... A47C 27/00; A47C 27/001
See application file for complete search history.

(56) References Cited

U.S. PATENT DOCUMENTS

| | | | | |
|---|---|---|---|---|
| 3,146,469 | A * | 9/1964 | Slade | A47C 27/144 5/695 |
| 4,449,261 | A * | 5/1984 | Magnusson | A47C 21/044 5/722 |
| 5,398,354 | A * | 3/1995 | Balonick | A47C 27/148 5/728 |
| 5,953,779 | A * | 9/1999 | Schwartz | A47C 27/001 5/692 |
| 6,516,481 | B1 * | 2/2003 | Erickson | A47C 27/144 5/723 |
| 6,742,205 | B2 * | 6/2004 | Dewert | A47C 20/041 5/236.1 |
| D593,349 | S | 6/2009 | Pittman | |
| 9,433,546 | B2 | 9/2016 | Rawls-Meehan | |
| 10,376,074 | B2 | 8/2019 | Aramli | |
| 10,463,153 | B2 | 11/2019 | Aramli | |
| 2003/0135930 | A1 * | 7/2003 | Varese | A47C 27/148 5/727 |
| 2008/0201856 | A1 * | 8/2008 | Howard | A47C 31/123 5/690 |
| 2009/0038080 | A1 * | 2/2009 | Grigg | A47C 27/001 5/720 |

(Continued)

OTHER PUBLICATIONS

U.S. Appl. No. 17/022,036, filed Sep. 15, 2020, Aramli, Mark.

*Primary Examiner* — Peter M. Cuomo
*Assistant Examiner* — Ifeolu A Adeboyejo
(74) *Attorney, Agent, or Firm* — Robert J. Hess; Hess Patent Law Firm

(57) ABSTRACT

A product upon which a person may lie down that includes a mattress whose underside has a peripheral flange or perimeter wall, i.e., a lip, that bounds a recessed cavity. The lip has gaps to accommodate passage of a power cord from within the recessed cavity to without. The lip and the mattress may have separate covers or both be within the same cover.

8 Claims, 11 Drawing Sheets

(56) References Cited

U.S. PATENT DOCUMENTS

| | | | | |
|---|---|---|---|---|
| 2009/0100606 | A1* | 4/2009 | An | A47C 27/064 5/716 |
| 2010/0287707 | A1* | 11/2010 | Beard | A47C 27/001 5/706 |
| 2011/0247144 | A1 | 10/2011 | Oh | |
| 2014/0366267 | A1 | 12/2014 | Suh | |
| 2017/0007035 | A1* | 1/2017 | Shi | A47C 27/144 |
| 2017/0325596 | A1* | 11/2017 | Torbet | A47C 27/18 |
| 2018/0125250 | A1 | 5/2018 | Dewert | |
| 2019/0150631 | A1* | 5/2019 | Pearce | A47C 27/144 |
| 2019/0298074 | A1 | 10/2019 | Dan-On | |
| 2019/0328150 | A1* | 10/2019 | Nolte | A47C 27/148 |
| 2019/0333127 | A1* | 10/2019 | Nolte | G06Q 30/0621 |

* cited by examiner

PRODUCT INCLUDES A LIP PROJECTING FROM AN OUTER PERIMETER OF AN UNDERSIDE OF A MATTRESS TO DEFINE A RECESSED CAVITY AND HAVING GAPS IN THE LIP FOR PASSAGE OF A POWER CORD

CROSS-REFERENCE TO RELATED APPLICATIONS

U.S. patent application Ser. No. 17/022,036.

STATEMENT REGARDING FEDERALLY SPONSORED RESEARCH OR DEVELOPMENT

Not applicable.

THE NAMES OF THE PARTIES TOA JOINT RESEARCH AGREEMENT

Not applicable.

REFERENCE TO A "SEQUENCE LISTING," A TABLE, OR A COMPUTER PROGRAM LISTING APPENDIX SUBMITTED ON A COMPACT DISC AND AN INCORPORATION-BY-REFERENCE

Not applicable.

BACKGROUND OF THE INVENTION

1. Field of Endeavor to which the Invention Pertains

The invention pertains to a mattress layer insert that removably fits into a recessed cavity of a mattress. The recessed cavity is at an underside of the mattress. The recessed cavity at the underside of the mattress is dimensioned to alternatively accommodate an adjustable power bed layer or adjustable bed lift mechanism after removal of the mattress layer insert. As an option, there could also be an additional recessed cavity at the topside of the mattress that has the same dimension as the recessed cavity at the underside of the mattress. Both recessed cavities are bounded by respective perimeter walls or peripheral flanges. An additional mattress layer insert would then be provided to fit into the recessed cavity at the topside of the mattress. If the additional mattress layer insert in the recessed cavity at the topside of the mattress wears out over time, it may be replaced by the mattress layer insert that had been in the recessed cavity at the underside of the mattress when the recessed cavity at the underside of the mattress is instead accommodating therein an adjustable power bed layer or adjustable bed lift mechanism.

2. Description of Information Known to the Inventor, Including References to Specific Documents Related to the Invention, and Specific Problems Involved in the State of Technology that the Invention is Drawn Toward U.S. patent application Ser. No. 17/022,036, whose contents are incorporated herein by reference, discloses a product upon which a person may lie down that includes a mattress whose underside has a peripheral flange that bounds a recessed cavity into which is placed an adjustable mechanism that can be actuated to raise or lower the head and foot portions of the mattress. The adjustable mechanism in its flattened state is hidden from view from the sides of the mattress by the peripheral flange. The adjustable mechanism is exemplified by an adjustable power bed layer of U.S. Pat. No. 10,463,163 B1, whose contents are incorporated herein by reference, and by an adjustable bed lift mechanism of U.S. Pat. No. 10,376,074 B2, whose contents are incorporated herein by reference. When the adjustable mechanism, in its fully folded, flattened condition, is fitted into the recessed cavity at the underside of the mattress, the adjustable mechanism becomes hidden from view because it sits atop a box spring or support surface and a perimeter wall or peripheral flange blocks view of it from the side of the mattress.

It is desired to provide one or two mattress layer inserts that can be alternatively fitted into respective recessed cavities at the underside and at the topside of a mattress. It is desired that the recessed cavities be of the same dimension and that the mattress layer insert in the recessed cavity at the underside of the mattress be removed to allow an adjustable power bed layer or adjustable bed lift mechanism be fitted therein instead.

SUMMARY OF THE INVENTION

One aspect of the invention relates to a recessed cavity at an underside of the mattress as disclosed in U.S. patent application Ser. No. 17/022,036 into which may be fitted a removable mattress layer insert. The dimension of the recessed cavity is such that, after removable of the removable mattress layer insert, it can accommodate an adjustable mechanism in its fully folded, flattened condition. The adjustable mechanism is exemplified by the power bed layer of U.S. Pat. No. 10,463,163 B1 and by the adjustable bed lift mechanism of U.S. Pat. No. 10,376,074 B2.

Another aspect of the invention relates to a recessed cavity at a topside of the mattress into which may be fitted an additional removable mattress layer insert. Preferably, the two removable mattress layer inserts are interchangeable with each other such that either can fit into the recessed cavities at the topside and underside of the mattress.

Both removable mattress layer inserts are enclosed by a covering that preferably matches the covering of the mattress.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE INVENTION

Figure 1:
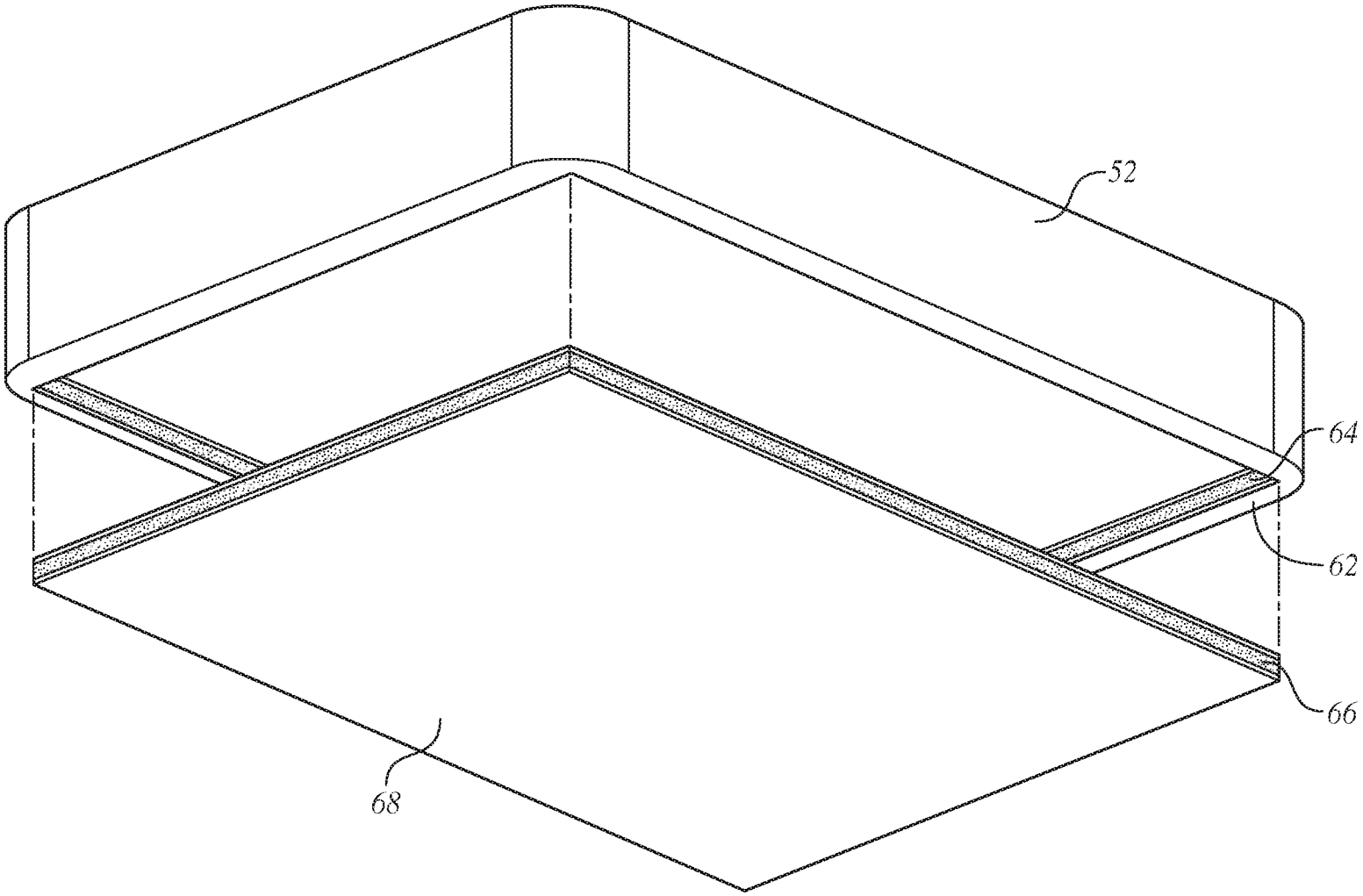
FIG. 1 is an isometric, exploded view of an underside of a mattress in accordance with an embodiment and into whose recessed cavity a mattress layer insert is being fitted.
Figure 2:
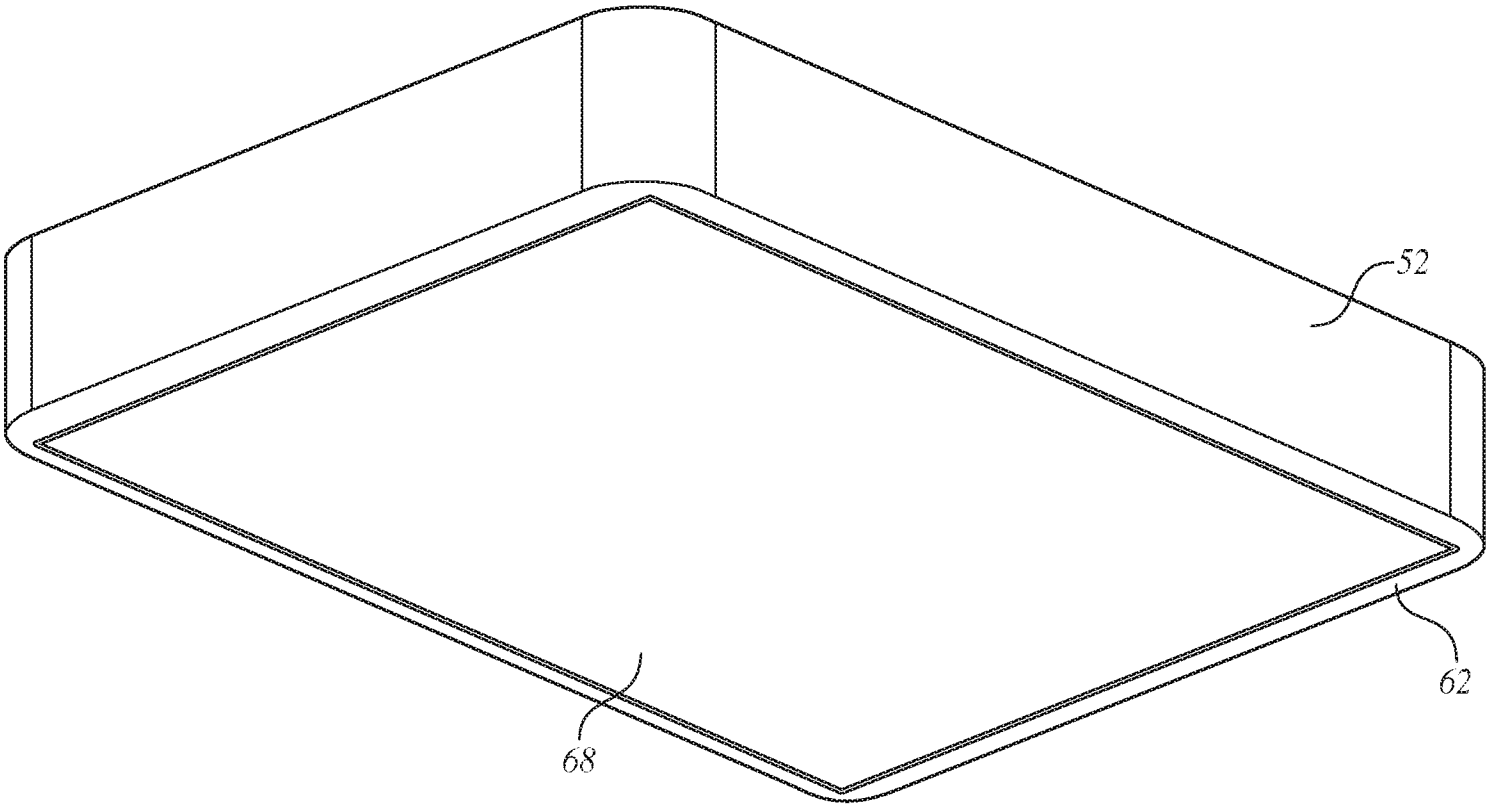
FIG. 2 is an isometric view of an underside of the mattress of FIG. 1 into whose recessed cavity the mattress layer has been fitted.

Turning to FIGS. 1 and 2 depict the modified mattress 52 of U.S. patent application Ser. No. 17/022,036, but which is further modified with the addition of fastener strips 66 of interlocking hooks and loops (under the tradename VELCRO) arranged on the inside facing surface of the perimeter wall or peripheral flange 62. Also depicted is a mattress layer 68 whose sides likewise have fastener strips 66 of interlocking hooks and loops.

Figure 3:
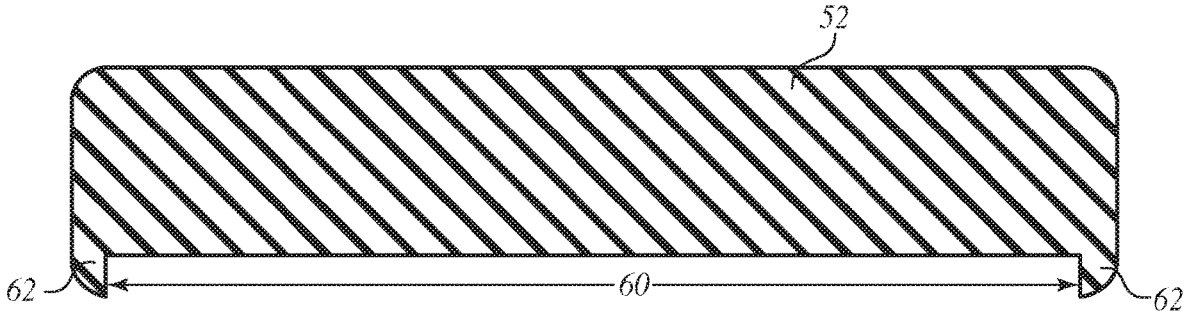
FIG. 3 is a cross-section of a modified mattress in accordance with the invention that has an underside with a peripheral flange that defines a recessed cavity.
Figure 4:
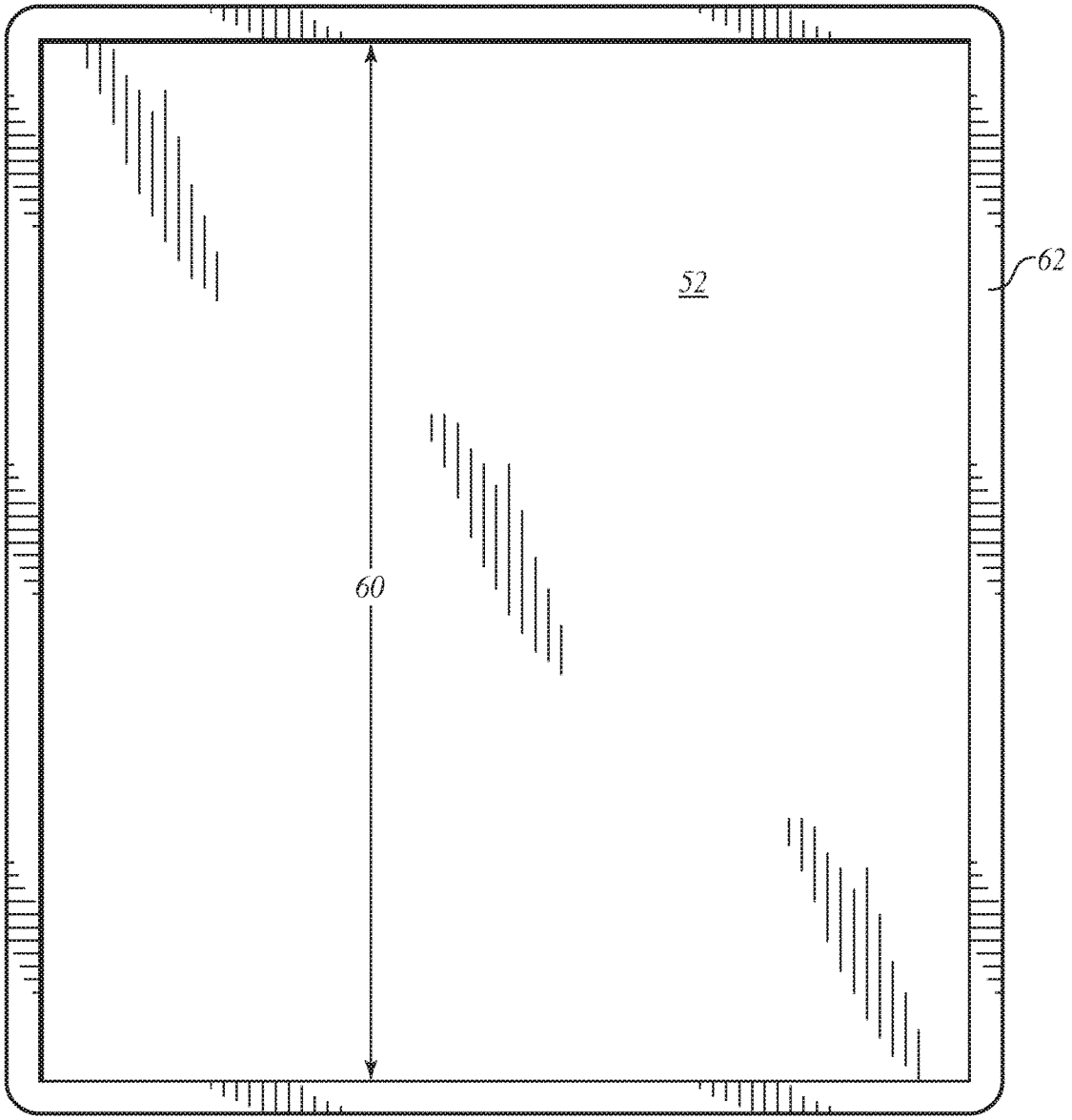
FIG. 4 is a bottom view of the modified mattress of FIG. 3.

Turning to FIGS. 3 and 4, the underside of the modified mattress 52 of FIGS. 1 and 2 defines a conventional mattress 50 and a recessed cavity 60 that is bounded at least partially by a perimeter wall or peripheral flange 62. Aside from the perimeter wall or peripheral flange 62 and glue (not shown) to retain the peripheral flange, the rest of the modified mattress 52 is the same as any conventional mattress but whose cover may also enclose the perimeter wall or peripheral flange 62. Otherwise, the perimeter wall or peripheral flange 62 can have its own matching cover to that of the conventional mattress and be glued onto the periphery of the underside of the conventional mattress to form the modified mattress 52.

The invention encompasses two approaches for the mattress:

1) the peripheral flange is glued or fastened to the bottom of the mattress during factory production, with the mattress cover modified to extend around to the interior of the peripheral flange, in this case the mattress can only be used with the adjustable power bed layer, and 2) the mattress is produced in an ordinary way with no built-in peripheral flange and the manufacturer makes available an optional stand-alone peripheral flange that has the same mattress cover materials on it that can be fastened to the bottom of the mattress via hook and loop, snaps, straps, etc. by the consumer. In this case, the bottom of mattress cover itself would need some simple fastening features on it so that the peripheral flange could be secured. Such allows the manufacturer to create a normal mattress that can be used without an adjustable power bed layer, but that includes only a slightly modified bottom cover surface that accepts fastening of the peripheral flange as an aftermarket add-on.

Figure 5:
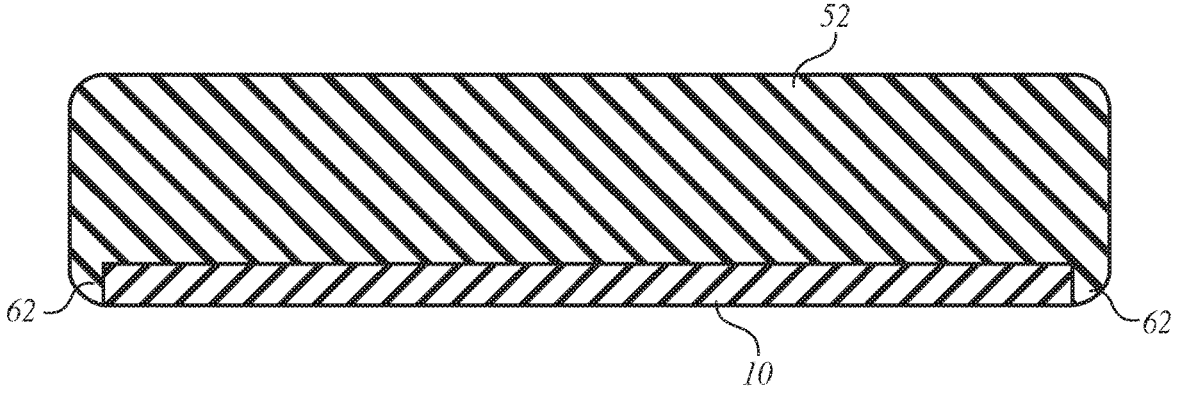
FIG. 5 is a cross-section of the modified mattress of FIG. 3 into whose recessed cavity is fitted an adjustable power bed layer or bed base. This combination of modified mattress and adjustable power bed layer can now be laid on any flat surface including a box spring or stationary, non-articulating bed frame such as a platform bedframe or ordinary bedframe.

Turning to FIG. 5, it can be appreciated that the recessed cavity 60 is dimensioned to snugly fit therein alternatively the mattress layer insert 68 or the adjustable mechanism 10 in its fully folded, flattened condition.

As can be appreciated from FIG. 5, the recessed cavity 60 in the bottom of the mattress form fits in a snug manner around the adjustable mechanism 10 (or the mattress layer insert 68). Thus, one can place the adjustable mechanism 10 (if present) down on a box spring, and then lay the modified mattress 52 on top of the adjustable mechanism 10, which becomes hidden inside the recessed cavity 60, giving the appearance of a "built in adjustable bed" to the modified mattress 52 itself because of the peripheral flange 62. Yet it would not have to be assembled with the mattress at a factory, it can be put together by simply stacking the conventional power bed layer/base 10 and the modified mattress 52 in the home. If no adjustable mechanism 10 is to be used, then the mattress layer insert 68 can take its place instead and be fitted into the recessed cavity 60.

Figure 6:
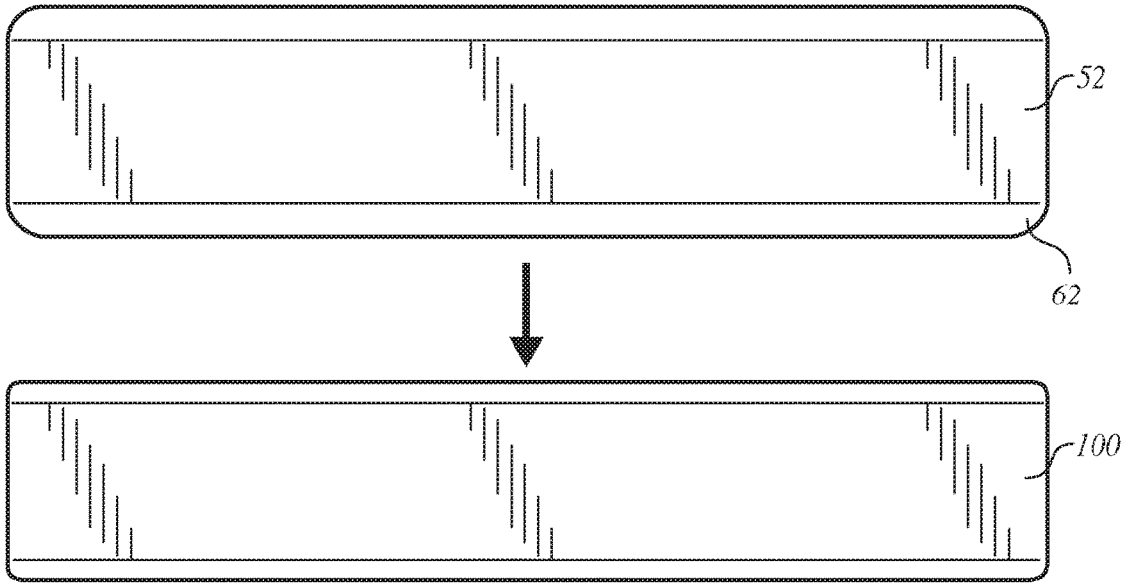
FIG. 6 is a side view of the modified mattress of FIG. 5 with the adjustable power bed layer or bed base hidden from view from the side by the peripheral flange and showing a box spring, upon which the modified mattress is placed.

To assemble, the adjustable mechanism 10 is placed initially on a box spring 100 of FIG. 6 and then the modified mattress 52 is placed on top with its recessed cavity 60 accommodating therein the adjustable mechanism 10. As an alternative to the box spring 100 of FIG. 6, a stationary, non-articulating bed frame such as a platform bed base 102 or any other typical bed frame may be used instead. That is, the adjustable mechanism 10 is placed initially on the non-articulating bed fame or platform bed base 102 of FIG. 7 and then the modified mattress 52 is placed on top with its recessed cavity 60 accommodating therein the adjustable mechanism 10. If there is no adjustable mechanism, then the mattress layer insert 68 can remain in the recessed cavity 60 instead as the mattress 52 is placed onto the box spring 100 of FIG. 6 or the non-articulating bed frame or platform bed base 102 of FIG. 7.

Figure 7:
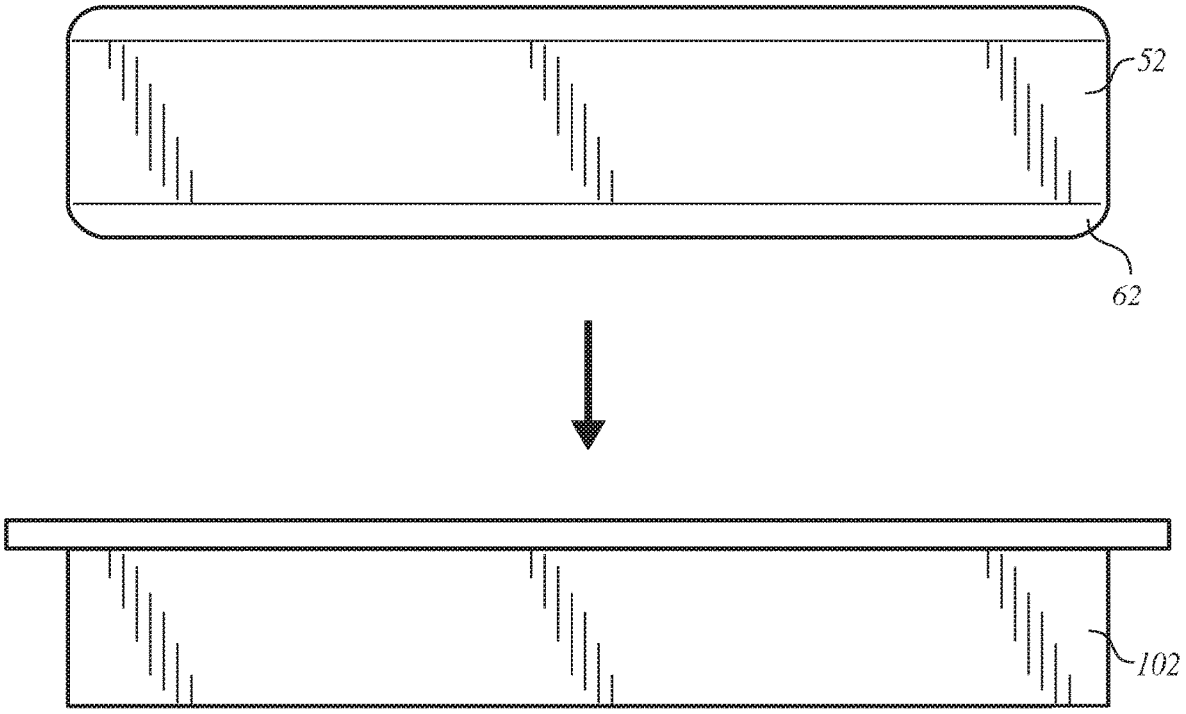
FIG. 7 is a side view of the modified mattress of FIG. 5 with the adjustable power bed layer or bed base hidden from view from the side by the peripheral flange and showing a stationary, non-articulating bed frame such as a platform bed base, upon which the modified mattress is placed.

With respect to FIGS. 6 and 7, the modified mattress 52 has a topside and four sides, with its underside placed upon a surface such as the box spring 100 of FIG. 6 or the non-articulating bed frame or platform bed base 102 of FIG. 7 and with recessed cavity 60 accommodating the adjustable mechanism 10 in its flattened condition (or the mattress layer insert 68 as the case may be). The adjustable mechanism 10 or the mattress layer insert 68 is thus hidden from view when in use, because the peripheral flange 62 blocks one from seeing them.

Figure 13:
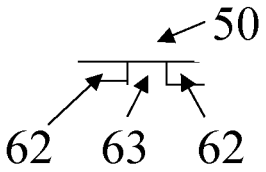
FIG. 13 is a schematic diagram showing a gap in the peripheral flange or perimeter wall.

In accordance with the invention, one may convert any conventional mattress to the same configuration of FIG. 3 just by securing a perimeter wall (peripheral flange 62) around the bottom perimeter of an existing mattress to create the recessed pocket for the adjustable mechanism 10 or for the mattress layer insert 68 by using the same material the mattress is constructed with for the perimeter wall or peripheral flange 62 and matching mattress cover material. As long as the perimeter wall (or peripheral flange 62) on the bottom of the mattress is fastened in place securely, it will act as if it was part of the mattress allowing one to put a fitted sheet onto the whole thing. The perimeter wall (or peripheral flange 62) is not expected to extend around an entirety of the perimeter of the underside of the mattress. Turning to FIG. 13, a gap 63 or opening is needed at two locations to enable passage of a DC power cord to pass through for powering the adjustable mechanism 10. The two locations are at the head and foot side of the perimeter wall (or peripheral flange 62) to allow for rotation of the mattress over time due to wear as is common practice for mattresses over the course of years.

Figure 8:
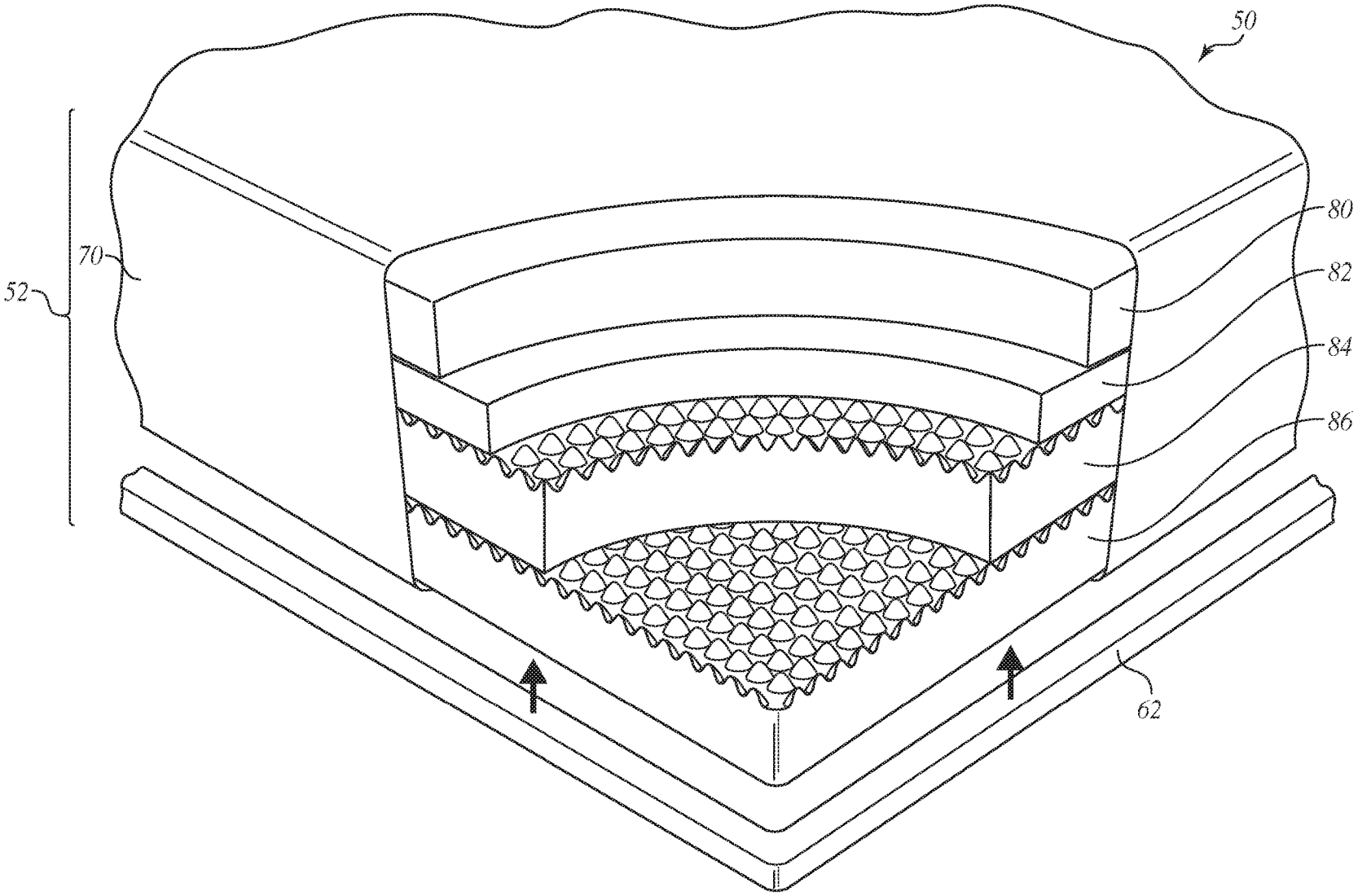
FIG. 8 is an isometric, broken view of a corner region of a conventional mattress to reveal foam layers within a cover.
Figure 9:
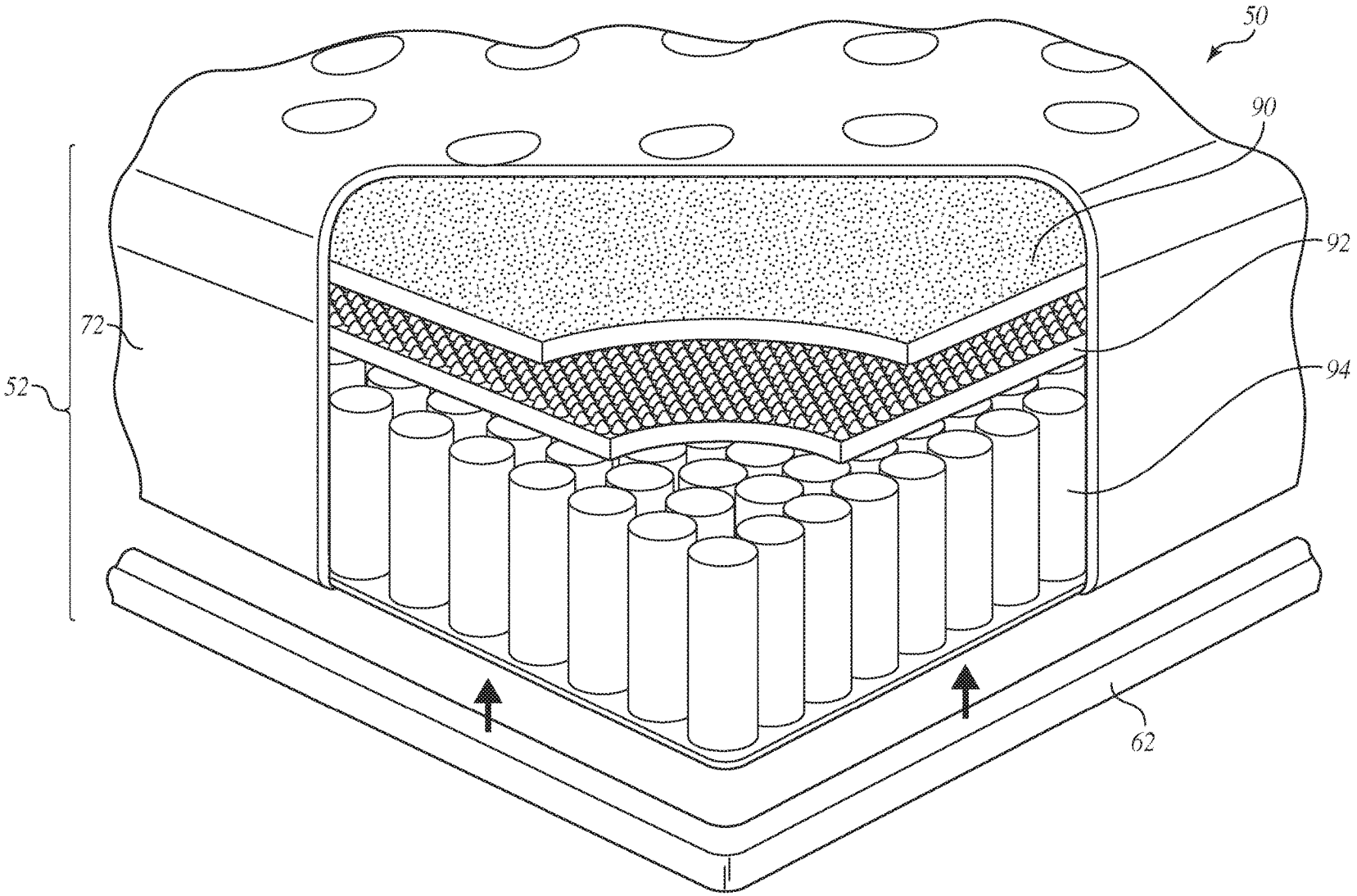
FIG. 9 is an isometric, broken view of a corner region of a further conventional mattress to reveal foam layers, a liner and coils within a cover.

Turning to FIGS. 8 and 9, it can be appreciated that conventional mattresses 50 are typically constructed in layers. The bottom layer will always be a few inches of "base support foam" (which is really stiff) or springs. The layers are typically glued together. In either case, there is always some bottom layer to the mattress before the fabric cover goes on. In the case of the conventional mattress 50 of FIG. 8, the layers from top to bottom within a knitted jacquard cover 70 include memory foam 80, comfort foam 82, high-density foam 84 and high-density base support foam 86. In the case of the conventional mattress 50 of FIG. 9, the layers under a quilted polyester tight-top cover 72 are, from top to bottom, responsive foam 90, edge crate foam 92, felt liner and individually wrapped coils 94. The present invention envisions adhering the perimetrical flange 62 (or perimeter wall) to the underside of any conventional mattress 50.

In the case of FIG. 8, the knitted jacquard cover 70 could be modified to enclose also the peripheral flange 62. In the case of FIG. 9, the quilted polyester tight-top cover 72 could be modified to enclose also the peripheral flange 62. By so extending the cover 70, 72, the modified mattress 52 would appear from the side to be continuous such that one would not notice from the side view that there is the attachment of the peripheral flange 62 to the underside of the mattress layers.

The head side of a mattress typically has a headboard that would block one's view of the underside of the mattress so that the contents of the recessed cavity 60 would not be seen from the head side. If there is no headboard, then it is typically the head side of the mattress that is adjacent a bedroom wall and thus the wall would block one's view of the underside of the mattress. Thus, there is no need for a perimeter wall of peripheral flange on the head facing side of the mattress and yet conceal the contents of the recessed cavity 60 from view.

In the case of the present invention, preferably, cut foam blocks or strips (stiff as typical mattress base foam) would form the perimeter "wall" or peripheral flange 62 on the mattress base, glued onto the bottom most layer and then upholstered over with the mattress fabric cover.

There may be a risk that the peripheral flange 62 may not be adequate with all mattresses in keeping the mattress from sliding off the end of the bed when the head side is raised (i.e., performing the function of the typical mattress retainer bar at the foot). This is probably a larger concern when no weight is on the mattress. Thus, it is preferred that some form of fastening be provided to deter the mattress from sliding off.

This form of fastening can be broad sections of hook-loop (VELCRO type) material glued or sewn to the bottom of the recessed surface at the underside of the mattress that defines the recessed cavity and glued or sewn to the top of the adjustable bed power layer, or even providing for mating snaps, or straps, or clamps to effect the fastening of the underside of the mattress to the adjustable bed power layer.

For the sake of brevity, the drawings do not show in detail the adjustable mechanism 10 in any of its actuated positions shown in U.S. Pat. No. 10,463,163 B1 (such as FIG. 13, 16, 19. 20, 22 of U.S. Pat. No. 10,463,163 B1), but any of such actuated positions may arise with the modified mattress 52 on top. By so doing, portions of the stationary frame of the adjustable power bed layer/base 10 would become visible underneath the modified mattress 52 because of the head and foot of the mattress 52 becoming elevated, but the actuated portions would likely remain hidden within the recessed cavity 60. Maintenance of the adjustable power bed layer/base 10 may be carried out in the same manner as set forth in U.S. Pat. No. 10,143,163 B1 by providing access to it upon removal of the modified mattress 52 from the adjustable power bed layer/base 10.

Likewise, for the sake of brevity, the drawings do not show the drawings of the adjustable bed lift mechanism of U.S. Pat. No. 10,376,074 B2. However, one can be substituted for the other in accordance with the invention. Thus, for purposes of this patent application, the adjustable mechanism collectively refers to the adjustable power bed layer/base 10 of U.S. Pat. No. 10,463,163 B1 as well as to the adjustable bed lift mechanism of U.S. Pat. No. 10,376,074 B2.

If desired, the adjustable mechanism may be equipped with legs, preferably legs that pivot to fold between an operative position, at which the legs extend down substantially perpendicular to the plane of the adjustable mechanism in its flattened condition, and a stowed position, at which the legs extend substantially parallel to the adjustable mechanism in its flattened condition and fit within confines of the recessed cavity 60 at the underside of the mattress 52.

Figure 10:
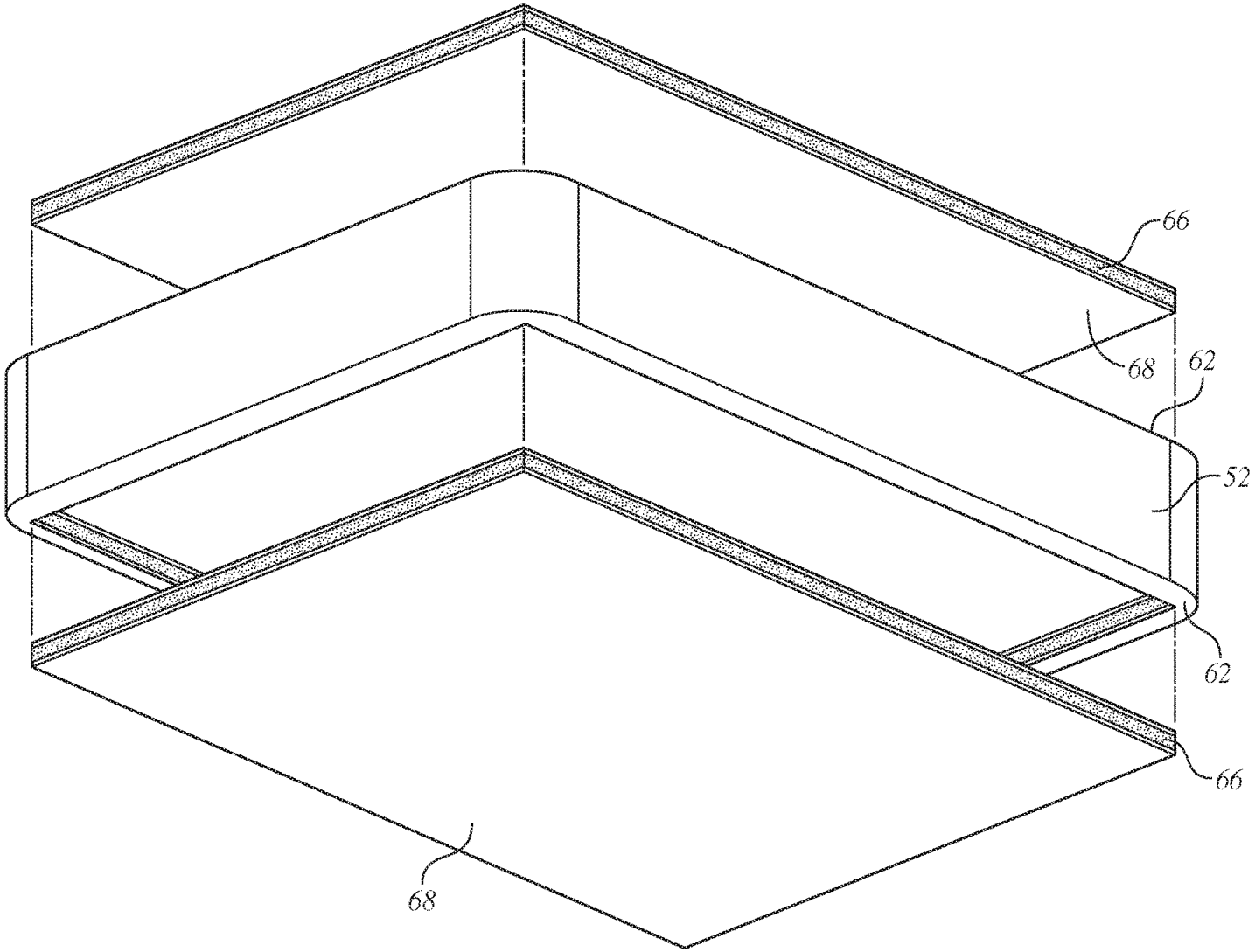
FIG. 10 is an isometric, exploded view of a mattress in accordance with a further embodiment and into whose recessed cavity at its underside is a mattress layer insert being fitted and into whose recessed cavity at its topside is a further mattress layer insert being fitted.
Figure 11:
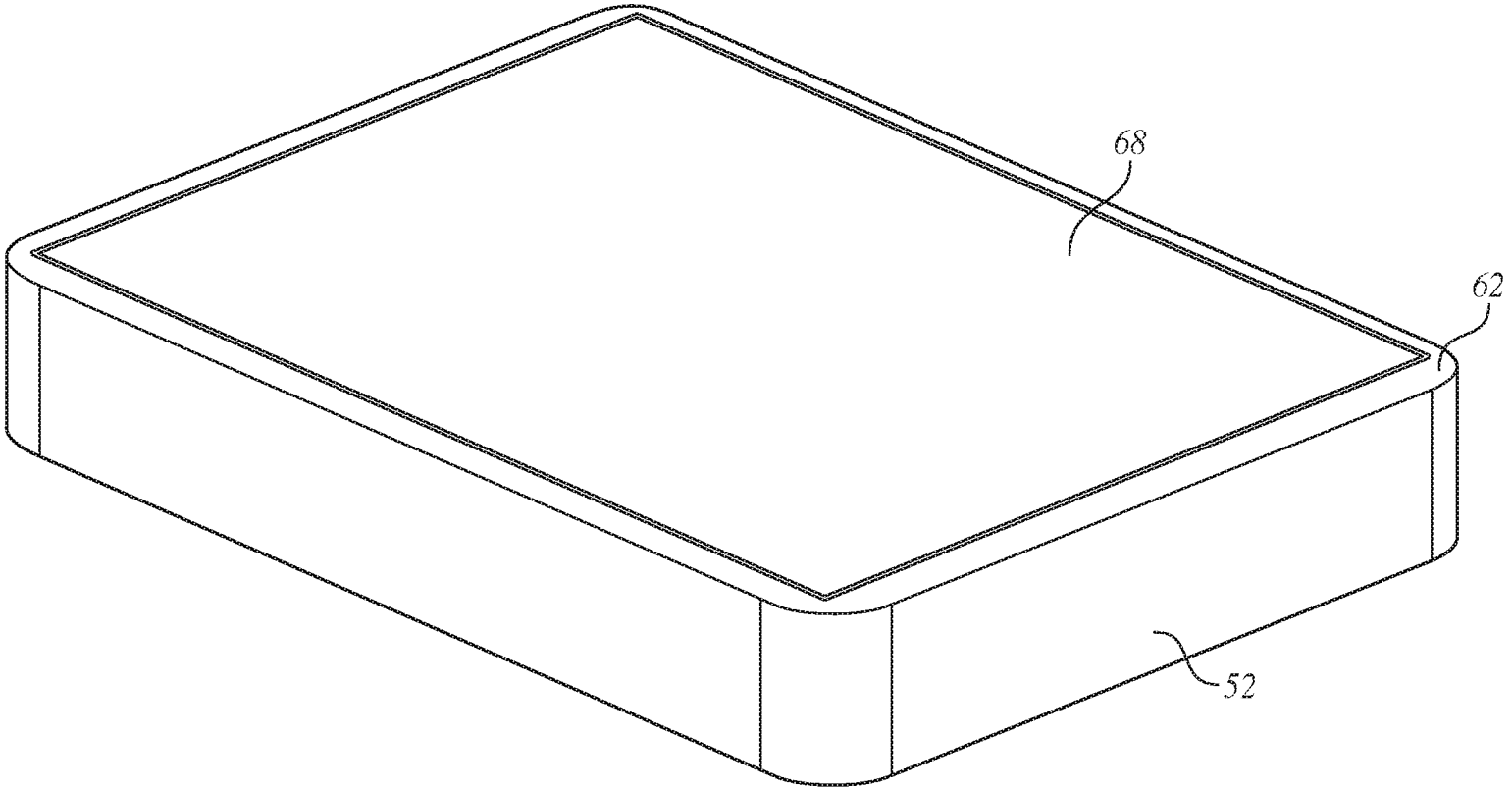
FIG. 11 is an isometric view of a topside of the mattress of FIG. 10 into whose recessed cavity at the topside of the mattress is fitted the further mattress layer insert.

Turning to FIGS. 10 and 11, a further embodiment is provided that is modification of the embodiment of FIGS. 1 and 2 in that provision is made on the topside of the modified mattress 52 for another recessed cavity. In that manner, the recessed cavities on the topside and the underside of the mattress can accommodate respective mattress layer inserts 58 that are preferably identical in dimension (and also preferably outward appearance) to each other. Thus, if the mattress layer insert 68 in the recessed cavity at the topside of the modified mattress 52 should wear over time, it can be interchanged with the mattress layer 68 from the recessed cavity at the underside of the modified mattress 52 to in effect extend the useful life of the modified mattress 52. A consumer could continue to extend the useful life of the modified mattress 52 by simply obtaining replacements for the mattress layer insert 68.

Figure 12:
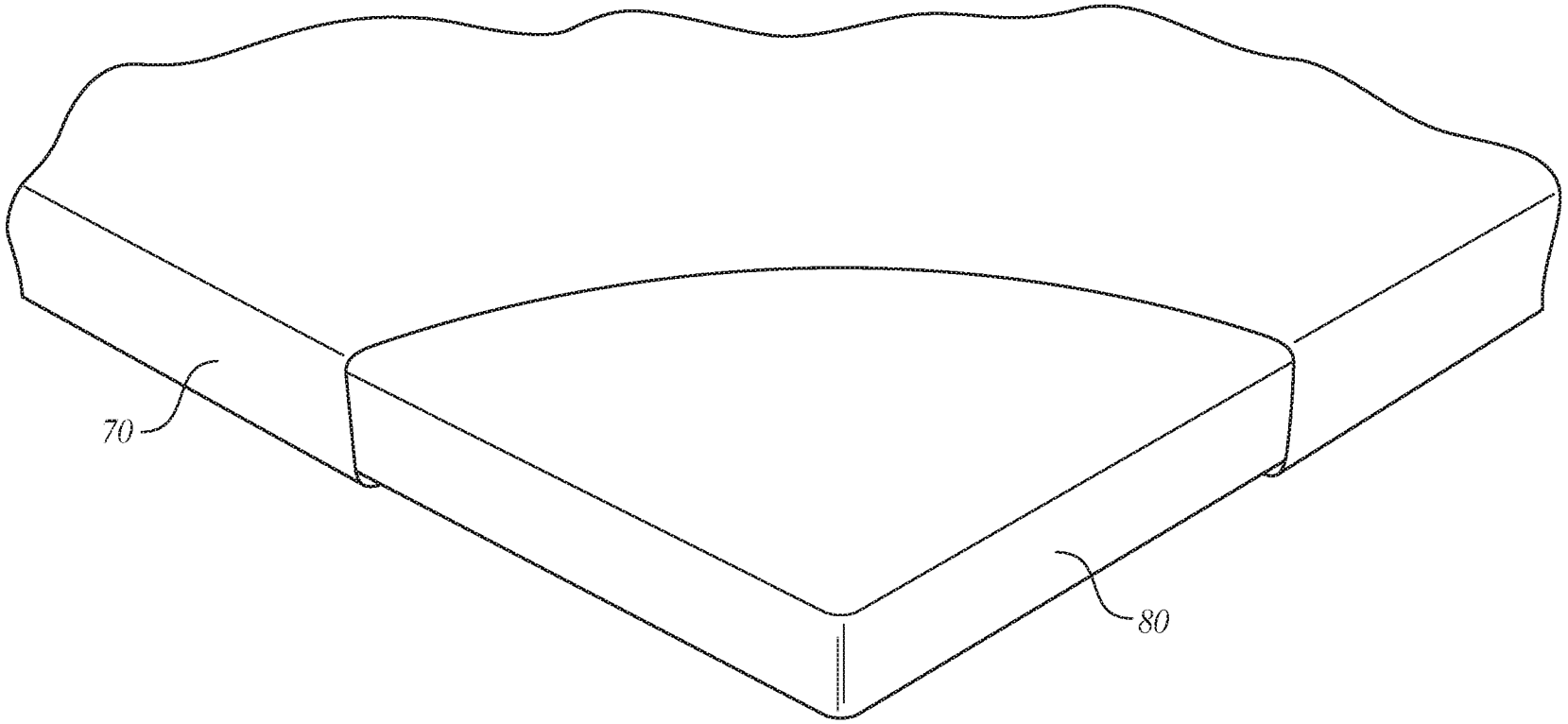
FIG. 12 is an isometric, broken view of a corner region of the mattress layer insert of FIG. 10 which is identical to that of the further mattress layer insert.

Turning to FIG. 12, both mattress layer inserts 68 are identical in that they both have a foam layer 80 (as per FIG. 8) enclosed within a cover 70 that matches the cover 70 of the mattress (as per FIG. 8). The foam layer 80 of FIG. 12 could be substituted for one of more foam layers 90, 92 (as per FIG. 9) depending upon with mattress is used and the depth of the recessed cavity 60. The fastener strip 66 of FIGS. 10 and 11 are added onto the cover 70 of the mattress layer insert 68 of FIG. 12.

The inside facing surface of the perimeter wall or recessed flange 62 that bounds the recessed cavity (not shown) in the topside of the modified mattress 52 may or may not have fastener strips 66 of hooks and loops arranged in a like manner to that on the inside facing surface of the perimeter wall or recessed flange 62 that bounds the recessed cavity 60 in the underside of the modified mattress 52 of FIG. 10. The fastener strips 66 may not be needed since gravity will keep the mattress layer insert in place within the recessed cavity in the topside of the modified mattress 52. On the other hand, the modified mattress 52 could be constructed such that it can be used for lying upon on either the topside or the underside so that the modified mattress 52 can be flipped over to switch the orientation of the topside and the underside. If so, then both recessed cavities should have the fastener strips 66 lining the inside facing surface of the perimeter wall or recessed flange 62 of both recessed cavities.

The recessed cavity in the topside of the modified mattress 52 is preferably identical in shape and dimension to that of the recessed cavity 60 (FIG. 4) in the underside of the modified mattress 52.

While the foregoing description and drawings represent the preferred embodiments of the present invention, it will be understood that various changes and modifications may be made without departing from the scope of the present invention.

What is claimed is:

1. A product upon which a person may lie down, comprising:

a configurable assembly that includes a mattress and a lip bounding a recessed cavity, the configurable assembly being configurable into a first configuration, which has a mattress layer insert fitting snugly within confines of the recessed cavity to constitute contents of the recessed cavity, and being configurable as an alternative into a second configuration, which has an adjustable mechanism abutting an underside of the mattress within the confines of the recessed cavity to instead constitute the contents of the recessed cavity, wherein the lip projects outward from an outer periphery of an underside of the mattress to overlap sides of the contents within the confines of the recessed cavity and thereby conceal same, the recessed cavity being accessible from below the mattress to gain access to the contents within the confines of the recessed cavity, the adjustable mechanism being configured to raise and lower a head and a foot of the mattress when actuated accordingly.

2. The product of claim 1, wherein the recessed cavity is bounded in part by the underside of the mattress, a topside of the mattress having a further recessed cavity whose size is the same as that of the recessed cavity at the underside of the mattress.

3. The product of claim 1, further comprising:

a power cord arranged for powering the adjustable mechanism, wherein the lip extends around the outer periphery of the underside of the mattress by less than an entirety of the outer periphery of the underside of the mattress to define at least one gap, the power cord being within the gap to extend from within the recessed cavity to outside the recessed cavity.

4. The product of claim 3, wherein the lip includes two pairs of opposing walls extending adjacent the outer perimeter of the mattress, one of the two pairs of opposing walls extending at head and foot sides of the mattress and thus defining two gaps and being spaced apart from each other, one of the two gaps being the gap within which is the power cord, the two gaps being at respective ones of the head and foot sides of the mattress, a remaining pair of the two pairs of opposing walls extending between the one pair of the two pairs of opposing walls and being spaced apart from each other.

5. The product of claim 1, further comprising:

two covers, one of the two covers covering the mattress and another of the two covers upholstering the lip.

6. The product of claim 4, further comprising:

two covers, one of the two covers covering the mattress and another of the two covers upholstering the lip.

7. The product of claim 1, wherein the lip includes opposing walls extending adjacent the outer perimeter of the mattress at head and foot sides of the mattress and each of the opposing walls defining a respective gap; further comprising:

a power cord for powering the adjustable mechanism, the power cord being within one of the respective gaps to extend from within the recessed cavity to outside the recessed cavity.

8. The product of claim 1, wherein the adjustable mechanism fits snugly within the recessed cavity.

* * * * *